United States Patent [19]

Benda et al.

[11] Patent Number: 4,552,345

[45] Date of Patent: Nov. 12, 1985

[54] CLAMP MECHANISM

[76] Inventors: Steven J. Benda, 6712 Glendower Rd., Apt. B, Raleigh, N.C. 27612; George M. Kivisto; Paul M. Kivisto, both of Box 47, Cokato, Minn. 55321

[21] Appl. No.: 574,034

[22] Filed: Jan. 26, 1984

[51] Int. Cl.[4] ..... B25B 1/20

[52] U.S. Cl. ..... 269/43; 269/113; 269/287; 269/221

[58] Field of Search ..... 269/166, 203, 204, 155, 269/156, 43, 287, 113, 111, 221, 110, 134, 136; 24/263 A

[56] References Cited

U.S. PATENT DOCUMENTS

| | | | |
|---|---|---|---|
| 1,194,666 | 8/1916 | Romanowski | 269/203 |
| 1,397,961 | 11/1921 | Holmquist | 269/110 |
| 1,602,684 | 10/1926 | Lancaster | 269/110 |
| 1,674,291 | 6/1928 | Malone | 269/110 |
| 1,730,510 | 10/1929 | Jensen | 269/134 |
| 3,024,521 | 3/1962 | Polk | 269/113 |
| 3,711,920 | 1/1973 | Simmons | 269/43 |
| 3,982,740 | 9/1976 | Gutman | 269/155 |
| 4,427,191 | 1/1984 | Hess | 269/43 |

FOREIGN PATENT DOCUMENTS

| | | | |
|---|---|---|---|
| 2902349 | 7/1980 | Fed. Rep. of Germany | 269/43 |
| 133913 | 9/1951 | Sweden | 269/136 |

*Primary Examiner*—Robert C. Watson
*Attorney, Agent, or Firm*—John J. Swartz

[57] ABSTRACT

Wood clamp apparatus for preventing the bowing of wood stock during the process of joining a plurality of wood strips including an underlying support for supporting a plurality of longitudinally extending strips of wood which are supported thereon, a pair of clamping blocks, and mechanism mounting one of the clamping blocks for movement toward and away from the other of the clamping blocks to exert edgewise pressure on the strips and clamp the plurality of board strips therebetween, and anti-bowing mechanism for precluding the upward bowing of the strips out of the plane of the strips, when the clamping blocks are in the clamping position, including laterally extending hold-down mechanism spanning the upper surfaces of the strips, and mechanism coupled to the clamps for vertically moving the hold-down mechanism between a raised position for vertically moving the clamping mechanism between a raised inoperative position and a lowered strip-clamping position, for exerting downward pressure on the strips to clamp them to the underlying support, and prevent them from moving upwardly out of the plane of the strips.

13 Claims, 4 Drawing Figures

CLAMP MECHANISM

BACKGROUND OF THE INVENTION

1. Field of the Invention

This invention relates to clamping apparatus, and, more particularly, to apparatus for clamping co-planar strips of wood in side-by-side abutting relation including mechanism thereon for preventing the bowing of the clamped wood strips out of the plane during the process of joining the strips.

2. Description of Prior Art and Objects of Invention

Various products, such as furniture, are constructed from a plurality of co-planar strips of wood which are glued together in edgewise relation. The abutting lateral edge surfaces of the wood strips are coated with a cement or glue and are then pressed tightly together via a clamping mechanism which holds the pieces of wood tightly together until the glue or cement dries.

During the joining process of multiple boards with the prior art clamping mechanism, a bowing or arching of the centermost strips, relative to the plane of the strips, sometimes occurs in the wood stock. This bowing or arching can be occasioned as a result of the flexing or bending of the clamping device frame.

One prior art clamping apparatus which has been heretofore utilized in clamping such wood pieces is commonly referred to as a "pipe pony clamp". Such a device utilizes one or more transversely extending pipes on which a plurality of side-by-side wood strips to be joined are mounted. A stop is mounted atop one end of each pipe, and a screw, mounting a clamp pad, is threadedly mounted atop the opposite end of the pipe. With this prior art construction, as the screw is turned and the clamp pad is moved toward the stop to exert edgewise clamping pressure on the abutting strips, moments are set up which can result in an arching or downward bowing of the pipe. Such pipe deformation results in a non-linear support surface for the strips of wood which are to be joined. Likewisely, moments are created which tend to upwardly move the strips, particularly the centermost strips, relative to the underlying pipe. Accordingly, once the pipe has flexed downwardly and/or the centermost strips have relatively arched or bowed upwardly, the plurality of wood stock pieces are no longer being laterally compressed in the same plane.

Accordingly, it is an object of the present invention to provide wood clamp apparatus for preventing the bowing of a plurality of wood strips during the process of joining the wood strips.

It is another object of the present invention to provide anti-bowing apparatus for retaining a plurality of wood strips in the same plane as they are being joined via edgewise clamping pressure.

Yet another object of the present invention is to provide a workpiece holder including clamp mechanism for exerting edgewise clamping pressure on a plurality of side-by-side wood strips, and additional clamping mechanism, movable with the clamp mechanism, for preventing bowing of the wood strips out of the plane of the wood strips.

Still another object of the present invention is to provide a workpiece holder including transversely extending support means on which a plurality of side-by-side longitudinally extending wood strips are supported, transverse clamping mechanism for exerting transverse clamping pressure on the side-by-side wood strips to hold the wood strips in side-by-side abutting relation, and additional hold-down mechanism mounted on the clamping mechanism for exerting downward force on the strips to clamp them to the underlying support.

Other objects and advantages of the present invention will become apparent to those of ordinary skill in the art as the description thereof proceeds.

SUMMARY OF THE INVENTION

Wood clamp apparatus for preventing the bowing of wood stock during the process of joining a plurality of wood strips, comprising transversly extending linear, support mechanism for supporting a plurality of longitudinally extending coplaner strips of wood in side-by-side relation; a pair of spaced-apart opposed clamping blocks relatively laterally, movably mounted atop the linear support for exerting sidewise clamping force on the strips to clamp the strips therebetween; mechanism mounting at least one of the clamps on the support for movement toward and away from the other of the clamps between non-clamping and clamping positions; and anti-bowing mechanism for preventing the relative vertical bowing movement of the strips and the support, comprising hold-down mechanism for spanning the upper faces of the wood strips, and mechanism movable with at least one of the clamps for vertically moving the hold-down mechanism between a raised inoperative position and a lowered strip-clamping position, for exerting downward force on the strips to clamp them to the support.

DESCRIPTION OF THE DRAWINGS

The invention may be more readily understood by referring to the accompanying drawings, in which.

DESCRIPTION OF PREFERRED EMBODIMENT

Figure 1:
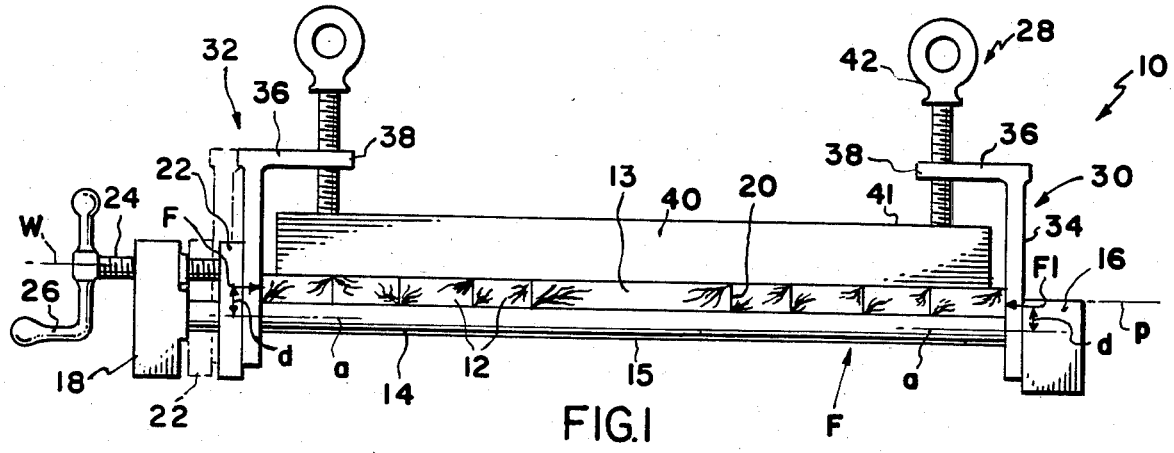
FIG. 1 is an end elevational view of clamping apparatus constructed according to the present invention.
Figure 2:
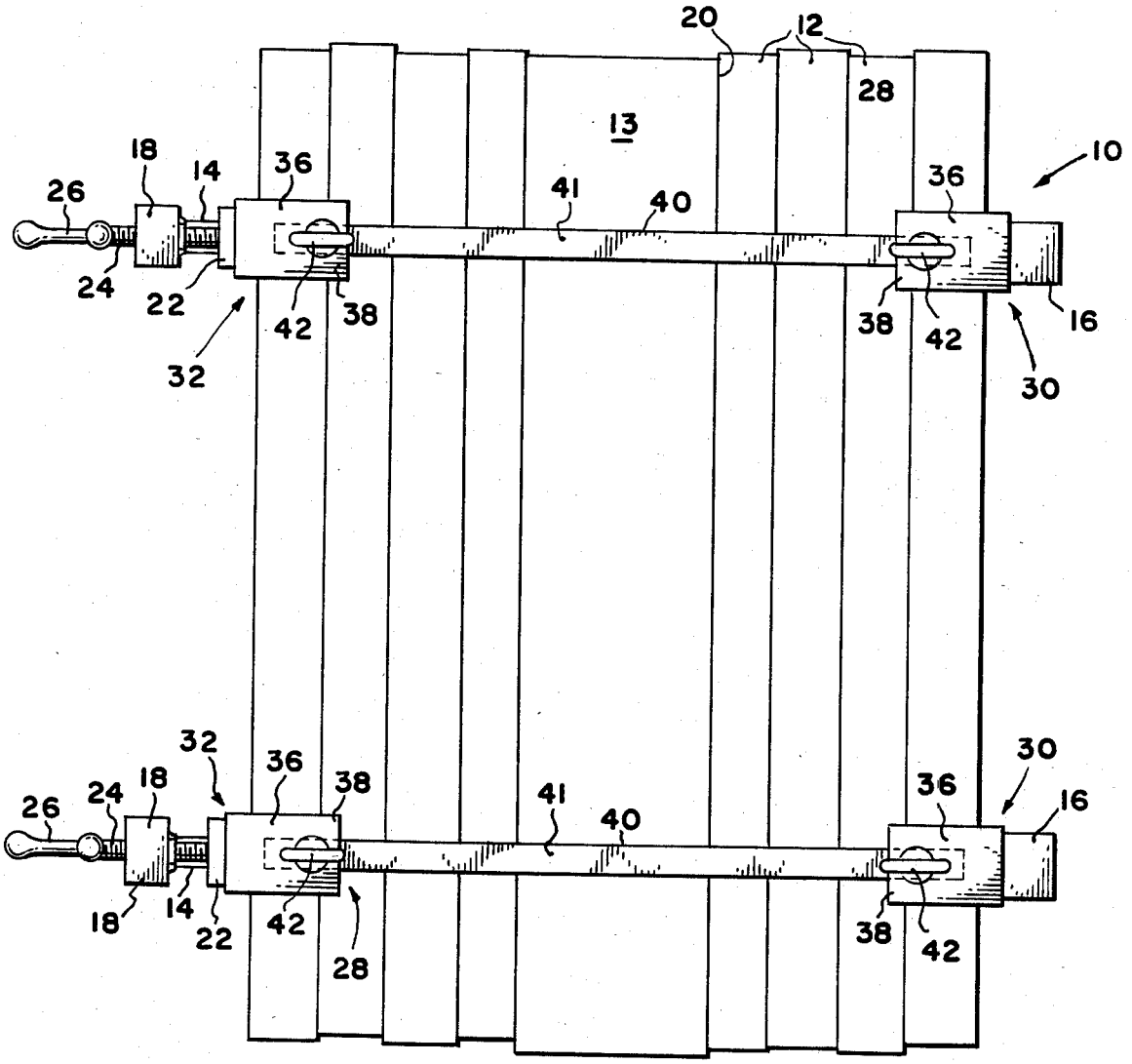
FIG. 2 is a top plan view of the apparatus illustrated in FIG. 1.

Apparatus constructed according to the present invention, generally designated 10, is provided for clamping a plurality of side-by-side, strips 12 of wood in edgewise abutting relation. The apparatus 10 includes an underlying frame, generally designated F, including a pair of longitudinally spaced, transversely extending guiderods 14 each having a stationary clamp pad stop 16 fixed at one end thereof and a mounting bracket 18 fixed to the opposite end thereof. The guiderods 14 are co-planar and provide the underlying support for the elongate wood strips or boards 12 which are mounted thereon as illustrated in FIGS. 1 and 2, in side-by-side abutting relation. Prior to being disposed in the abutting positions illustrated in FIG. 1, the abutting lateral edge side surfaces 20 of strips 12 have cement or glue applied thereto.

Each of the support guiderods 14 slidably mounts a clamp pad 22 for exerting edgewise clamping force on the wood strips 12. Each of the clamp pads 22 is moved between non-clamping position, illustrated in chain lines in FIG. 1, and a clamping position, illustrated in solid lines in FIG. 1, by means of a screw 24 threadedly mounted in the bracket 18 and rotatably coupled to the clamp pad 22 such that as the screw 24 is turned about its axis W, the pad or slide 22 will move linearily along the guiderod 14. A handle 26 is fixed to the laterally outer end of screw 24 to conveniently turn the screw 24 about its axis W.

To preclude upward bowing of the wood strips 12 out of the plane p of the wood strips, and downward bowing of the support guiderods 14 out of a plane intersecting the axes a of the support pipes 14, and thus prevent the formation of an undesireable gap between the center most wood strip 13 and the center most portion 15 of the guiderods 14, the apparatus 10 includes anti-bowing mechanism, generally designated 28. The anti-bowing mechanism 28 includes a pair of inverted L-shaped brackets, generally designated 30 and 32 mounted on the stationary clamp pad stop 16 and movable clamp pad 22 respectively. Each of the clamp pads 30 and 32 include an upstanding portion 34 which is slidably received on the support guiderods 14 such that as the clamp pad 32 is moved laterally inwardly, the upstanding portion 34 of bracket 32 will likewisely move laterally inwardly.

Fixed to the upstanding portion 34 on each of the mounting brackets 30 and 32 is transversely inwardly extending clamp bar 36 having a laterally inner portion 38 overlying the laterally outer ones of the abutting wood strips 12.

The anti-bowing mechanism 28 includes a pair of hold-down bars 40 each lying in a vertical plane intersecting the axis a of the underlying support pipe or guiderod 14. As is evident from the drawing, the length of hold-down bars 40 is less than the overall width of the strips but is sufficient to span portions of the two laterally outermost wood strips 12.

A thumb screw, generally designated 42, is threadedly mounted on each of the clamp bars 36 for vertical movement between a raised, inoperative position, and a lowered clamping position, illustrated in FIG. 1, to exerting downward clamping force on the hold-down bar 40 and clamp the wood strips 12 to the bars 14.

THE OPERATION

Each clamp pad 22 is initially positioned in the laterally outer, inoperative position illustrated in chain lines in FIG. 1, and the boards or wood strips of 12 are disposed on the pipes 14 in abutting relation, after having had their lateral side edge surfaces 20 coated with glue or other suitable adhesive. The thumb screws 42 are initially in raised, inoperaive positions.

The clamp pad translating screws 24 are then rotated about their axes W to laterally inwardly move the clamp pads 22 to the position illustrated in FIG. 1. As the clamp pad 22 is moved inwardly, the anti-bowing mechanism 28 is carried by the clamp pads to the laterally inner positions illustrated in FIG. 1 with the clamp pads 16 and 22 positioned as illustrated in FIG. 1, an edgewise force F, a distance d from the axis a of the guiderod 14, will be exerted on the wood strips 12 by the clamp pad 22 and an opposing force F1 will be exerted on the wood strips 12 by the stationary clamp pad 16 an identical distance d from the axis a of the guiderod 14. The forces F and F1 set up moments M and M1 about each respective clamp points. These moments tend to cause a downward bowing of the guiderods 14 and an upward bowing of the wood pieces 12.

The hold-down bars 40 are then disposed on the upper surfaces 41 of the boards 12 in vertical alignment with the axes a of the support pipes 14. The thumb screws 42 are turned in such a direction as to move the thumb screws to the position illustrated in FIG. 1. The hold down bars 40 and bolts 42 may be moved to the positions illustrated in FIG. 1 prior to the clamp pad 22 reaching its final position.

Without the use of applicant's anti-bowing device 28, a gap between the center board 13 and the central most portion 15 of pipes 14 could be created. This would result in the wood strips 12 no longer being compressed in the same plane p and thus the resultant product would be scrap. With the hold-down bar 40 being clamped tightly to the upper surfaces 41 of the strips 12 via the bolts 42, counter moments are set up which prevent the pipes 14 from bowing downwardly and the wood stock strip 12 from bowing upwardly relative thereto.

It is important that the brackets 30 for the hold-down bolts 42 be coupled to the pipes 14 at a level below the strips of wood 12 being clamped in order to set up the proper counter balancing counter moments to prevent the bowing of pipes 14 and strips 12. This causes a plurality of downward forces being exerted on the upper surfaces of the strips 12 at an infinite number of locations along the length of hold-down bars 40 to distribute the downward force exerted by thumb screws 42 and thus create opposing moments that cause the pipe 12 to remain linear and to prevent the bowing of strips 14.

ALTERNATE EMBODIMENT

Figure 3:
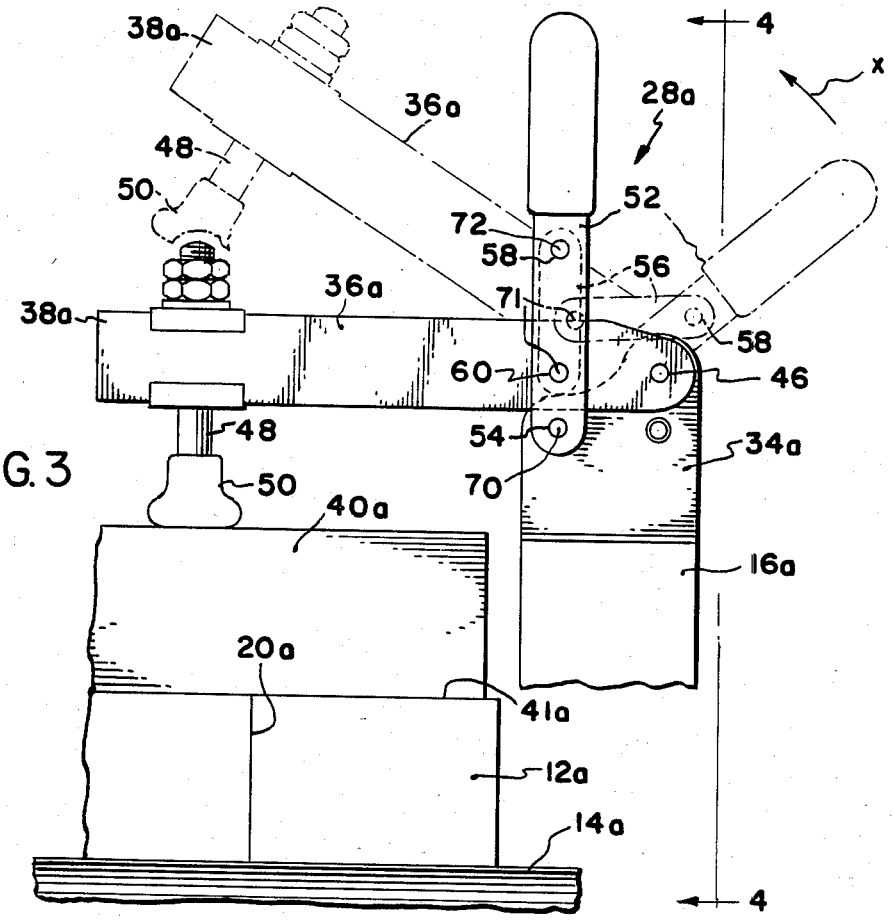
FIG. 3 is an enlarged end elevational view, similar to FIG. 1, illustrating modified clamping apparatus constructed according to the present invention.
Figure 4:
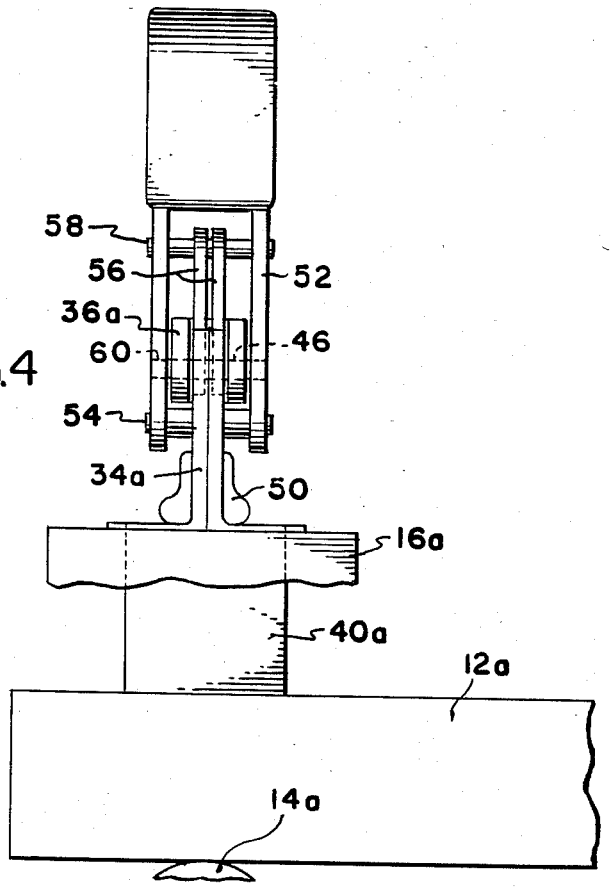
FIG. 4 is a side elevational view, taken along the line 4—4 of FIG. 3.

A slightly modified embodiment is illustrated in FIGS. 3 and 4 wherein similar parts will be referred to by similar reference characters followed by the letter a subscript. The anti-bowing mechanism **28*a* likewisely includes a hold-down bar 40*a*. The clamp pads 16*a* and 22*a* each mount an upstanding support arm 34*a* which pivotally mounts, via pivot pin 46, a laterally inwardly extending clamp bar 36*a*. Mounted at the outer terminal end 38*a* of the clamp arm 36*a* is a vertically adjustable bar 48 threaded having an enlarged hold-down head 50 which engages the upper surface of the hold-down bar 40*a*. The clamp bar 36*a* is pivotally movable from the operative, hold-down position, illustrated in FIG. 3 to the inoperative raised position, illustrated in chain lines in FIG. 3, by means of a lever arm 52 which is pivotally mounted via a pivot pin 54 on the upstanding support arm 34*a*. A link 56 is pivotally coupled to the lever arm 52 via a pivot pin 58 and to the clamp bar 36*a* via a pivot pin 60. When the strips 12*a* are placed on the support pipes or guiderods 14*a* and the clamp pads are moved to the clamping position, and hold-down bars 40*a* are placed on the upper surfaces 41*a* of the strips 12*a***.

The hold-down mechanism **28*a* in initially in the position illustrated in chain lines in FIG. 3. At this time, the handle 52 is moved counter clockwisely, in the direction of the arrow X, to the clamping position, illustrated in solid lines in FIG. 3, such that the axes 70, 71 and 72 of pivot pins 54, 60 and 58 respectively are in vertical "on-center" alignment to lock the clamp arm 36*a* in the position illustrated in solid line in FIG. 3**.

After the adhesive between the abutting strip edges **20*a* sufficiently dries, the handle or lever 52 is again moved to the position illustrated in chain lines in FIG. 3 to release the downward counter moment force on the upper surfaces of the strips 12*a*** so that the finished product can be removed from the fixture.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention of the scope of the appended claims.

What we claim is:

1. A workpiece holder for clamping a plurality of elongate side-by-side abutting co-planar strips of wood to be joined, each of said strips including top and bottom surfaces spanned by lateral side edge surfaces which abut the adjacent side edge surfaces of adjacent strips, said holder comprising:

transversely extending linear support means for supporting a plurality of longitudinally extending co-planar strips of wood in side-by-side relation;

a pair of opposed, laterally spaced apart clamping blocks;

means mounting said clamping blocks on said support means for relative lateral movement toward and away from each other between non-clamping positions, spaced apart a predetermined distance, and less spaced apart clamping positions to exert edgewise pressure on said strips and to clamp said plurality of strips therebetween;

means reacting between said support means and said clamping blocks for moving said clamping blocks between said clamping and non-clamping positions;

anti-bowing means for precluding the upward bowing of said strips out of the plane of said strips when said clamping blocks are in said clamping positions exerting edgewise clamping pressure on said strips, comprising:

laterally extending hold-down means disposed above and spanning said strips;

means coupled to said clamping blocks for movement therewith and for movement relative thereto for vertically moving said hold-down means between a raised inoperaive position and a lowered strip clamping position for exerting downward pressure on said hold-down means and said strips to clamp said strips to said support means and prevent them from moving upwardly out of the plane of said strips;

said anti-bowing means comprising a pair of bracket means mounted on said support means for relative movement with said clamping blocks; said bracket means extending laterally inwardly of said support means and having a portion thereof overlying said strips.

2. The workpiece holder set forth in claim 1 wherein each of said bracket means comprises a generally upstanding leg mounted on said support means laterally outwardly of said strips of wood and including an aperture therein receiving said means for moving said clamping blocks;

said bracket means further including a transversely inwardly extending leg including said portion overlying said strips; said means for vertically moving said hold-down means comprising vertically adjustable means mounted on said transversely inwardly extending leg.

3. The workpiece holder set forth in claim 2 wherein said hold-down means comprises a hold-down bar; said vertically adjustable means comprising screw means threadedly mounted on said transversely extending leg for bearing against the upper surface of said hold-down bar.

4. A workpiece holder for clamping a plurality of elongate side-by-side abutting co-planar strips of wood to be joined, each of said strips including top and bottom surfaces spanned by lateral side edge surfaces which abut the adjacent side edge surfaces of adjacent strips, said holder comprising:

transversely extending linear support means for supporting a plurality of longitudinally extending co-planar strips of wood in side-by-side relation;

a pair of opposed, laterally spaced apart clamping blocks;

means mounting said clamping blocks on said support means for relative lateral movement toward and away from each other between non-clamping positions, spaced apart a predetermined distance, and less spaced apart clamping positionss to exert edgewise pressure on said strips and to clamp said plurality of strips therebetween;

means reacting between said support means and said clamping blocks for moving said clamping blocks between said clamping and non-clamping positions;

anti-bowing means for precluding the upward bowing of said strips out of the plane of said strips when said clamping blocks are in said clamping positions exerting edgewise clamping pressure on said strips, comprising: laterally extending hold-down means disposed above and spanning said strips;

means coupled to said clamping blocks for movement therewith and for movement relative thereto for vertically moving said hold-down means between a raised inoperative position and a lowered strip clamping position for exerting downward pressure on said hold-down means and said strips to clamp said strips to said support means and prevent them from moving upwardly out of the plane of said strips;

said means movable with said clamps for vertically moving said hold-down means including a first portion laterally slidably coupled to said support means at the underside of the plane of said wood strips and a second laterally inwardly extending transverse portion on the upper side of the plane of the wood strips, and additional clamp means mounted on said second portion for exerting downward force on said hold-down means.

5. The workpiece holder set forth in claim 4 wherein said mean movable with said clamp for vertically moving said hold-down means comprises an L-shaped bracket.

6. Wood clamp apparatus for preventing the bowing of wood stock during the process of joining a plurality of co-planar strips of wood stock, comprising:

at least one underlying, longitudinally spaced, transversely extending, linear support bar for supporting a plurality of longitudinally extending strips of wood to be joined in abutting relation;

first and second laterally spaced clamp means mounted atop said support bar for exerting sidewise clamping pressure on said strips to sidewisely clamp said strips therebetween;

means mounting at least one of said first and second clamp means on said support bar for movement toward and away from the other of said clamp means between a laterally inner clamping position and a laterally outer, non-clamping position;

anti-bowing mechanism for preventing relative vertical bowing movement of said strips and said support means, comprising:

hold-down means spanning the upper faces of said wood strips;

support mechanism, coupled to said clamp means for movement therewith and for movement relative thereto, including a transversely inwardly extending clamp bar having a portion overlying a portion of said wood strips; and additional clamp means reacting between said clamp bar and said hold-down means for moving said hold-down means toward said support bar to tightly clamp said wood strips between said hold-down means and said support bar.

7. The apparatus set forth in claim 6 wherein said support mechanism includes a portion mounted on said support, laterally inwardly of said clamp means, for sliding movement relative thereto.

8. The apparatus set forth in claim 7 wherein said support mechanism is laterally inwardly movable in response to laterally inward movement of said clamp means.

9. The apparatus set forth in claim 6 wherein said clamp bar is pivotally mounted for swinging movement between a raised inoperative position and a lowered clamping position.

10. The apparatus set forth in claim 9 wherein means is provided for releasably locking said clamp bar in said lowered position comprising lever means pivotally mounted on said support mechanism, and link means pivotally coupling said lever, means and said clamp bar.

11. The apparatus set forth in claim 10 wherein said lever means is pivotally mounted on said support means for swinging movement about a first axis between an unlocked position and a locking position; said link means is pivotally coupled to said clamp bar for movement relative thereto about a second axis and pivotally coupled to said lever means for movement relative thereto about a third axis; said first, second and third axes lying in the same plane when said lever means is in said locking position to releasably lock said clamp bar in said lowered clamping position.

12. Wood clamp apparatus for preventing the bowing of wood stock during the process of joining a plurality of co-planar strips of wood stock, comprising:

at least one underlying, longitudinally spaced, transversely extending, linear support bar for supporting a plurality of longitudinally extending strips of wood to be joined in abutting relation;

first and second laterally spaced clamp means mounted atop said support bar for exerting sidewise clamping pressure on said strips to sidewisely clamp said strips therebetween;

means mounting at least one of said first and second clamp means on said support bar for movement toward and away from the other of said clamp means between a laterally inner clamping position and a laterally outer, non-clamping position;

anti-bowing mechanism for preventing relative vertical bowing movement of said strips and said support means, comprising:

hold-down means spanning the upper faces of said wood strips;

support mechanism, coupled to said support bar, including a portion mounted on said support bar, laterally inwardly of said clamp means, for sliding movement relative to said support bar, and a transversely inwardly extending clamp bar having a portion overlying a portion of said wood strips; and additional clamp means reacting between said clamp bar and said hold-down means for moving said hold-down means toward said support bar to tightly clamp said wood strips between said hold-down means and said support bar.

13. The apparatus set forth in claim 12 wherein said support mechanism is laterally inwardly movable in response to laterally inward movement of said clamp means.

* * * * *